US007547374B2

(12) United States Patent
Snekkenes

(10) Patent No.: US 7,547,374 B2
(45) Date of Patent: Jun. 16, 2009

(54) METHOD FOR IMPREGNATING CHIPS IN A CONTINUOUS DIGESTION SYSTEM

(75) Inventor: Vidar Snekkenes, Karlstad (SE)

(73) Assignee: Metso Fiber Karlstadt AB, Karlstad (SE)

( * ) Notice: Subject to any disclaimer, the term of this patent is extended or adjusted under 35 U.S.C. 154(b) by 307 days.

(21) Appl. No.: 11/670,086

(22) Filed: Feb. 1, 2007

(65) Prior Publication Data

US 2007/0187052 A1 Aug. 16, 2007

(30) Foreign Application Priority Data

Feb. 10, 2006 (SE) ..... 0600309

(51) Int. Cl.
*D21C 11/00* (2006.01)

(52) U.S. Cl. ..... 162/29; 162/17; 162/19; 162/47; 162/237; 162/249; 162/250; 162/251

(58) Field of Classification Search ..... 162/29, 162/17, 19, 47, 37, 40
See application file for complete search history.

(56) References Cited

U.S. PATENT DOCUMENTS 5,529,661 A 6/1996 Backlund
5,679,217 A 10/1997 Outzen
2004/0060672 A1 * 4/2004 Snekkenes et al. ..... 162/19

FOREIGN PATENT DOCUMENTS

| | | |
|---|---|---|
| EP | 1561856 | 8/2005 |
| SE | 334809 | 3/1971 |
| SE | 518 738 | 11/2002 |
| SE | 518 957 | 12/2002 |
| SE | 527 058 | 12/2005 |
| WO | 03062525 | 7/2003 |

* cited by examiner

*Primary Examiner*—Mark Halpern
(74) *Attorney, Agent, or Firm*—Rolf Fasth; Fasth Law Offices

(57) ABSTRACT

A method for impregnating chips in a continuous digestion system with an impregnation vessel and a digester. The digestion system has a heat exchanger arranged between a first return line and a black liquor line. The heat exchanger allows a transfer of heat between the two lines. A principal part of the fluid contents of the impregnation vessel is constituted by chips moisture, steam condensate, added white liquor, and the fluid withdrawn from the top separator at the first return line, whereby the impregnation fluid in the impregnation vessel does not contain any substantial amount of black liquor from the digester. An impregnation vessel is established that is hydraulically isolated, in which the flow of fluid and the establishment of its alkali content take place without any influence from the fluid flow in the digester process.

13 Claims, 4 Drawing Sheets

METHOD FOR IMPREGNATING CHIPS IN A CONTINUOUS DIGESTION SYSTEM

PRIOR APPLICATION

This is a US national phase patent application that claims priority from Swedish patent application no. 0600309-9 filed 10 Feb. 2006.

TECHNICAL AREA

The present invention concerns a method for the impregnation of chips in a continuous digestion system.

BACKGROUND OF THE INVENTION

The process of withdrawing spent or partially spent cooking fluid at the cooking temperature, this fluid being known as "black liquor", from various positions in the digester with a certain level of residual alkali, and the subsequent leading of this spent cooking fluid, from which the pressure has been partially or fully released, at a temperature of approximately 90-120° C. to an impregnation vessel for impregnation, during the continuous cooking of chemical cellulose pulp in a two-vessel system is known. This process is known as "black liquor impregnation". The principal aim of this type of impregnation is to obtain a good impregnation of the alkali black liquor, such that the chips are fully neutralised and given an alkali pH. A further aim is to be able to conserve to a greater degree the heat in the withdrawn cooking fluid in order to heat the colder chips in the impregnation vessel.

The conservation of a part of the heat from the hot black liquor in association with black liquor impregnation is also known. This traditionally takes place through the pressure of the steam being removed with pressure-reduction cyclones, and where this flash steam is used for, among other purposes, the pre-treatment of the chips, or for other heating purposes. The conservation of the heat energy from the black liquor by allowing the black liquor to pass through a heat exchanger is also known.

SE 518 957 C2 reveals a method for improving the heat economy of a continuous digestion system. Hot black liquor is withdrawn in this case from the digester, and returned to the bottom of the impregnation vessel, with the aim of increasing the temperature of the chips in the feed line up to the digester. A portion of the heated fluid is withdrawn from the feed line at the top separator and sent to the impregnation vessel in order to function as impregnation fluid.

SE 518 738 C2 reveals a method and an arrangement for improving the impregnation of chips in a continuous digestion system. Chips that have not been pre-treated with steam are fed to an impregnation vessel in which a fluid level (LIQ_LEV) is established that lies under the highest level of the chips (CH_LEV).

An improved impregnation arrangement for the chips is achieved through the addition of impregnation fluids (BL1/BL2/BL3), in the form of cooking fluids that have had the full cooking temperature, with increasing temperatures at different positions (P1, P2, P3), and through the establishment of a zone (Z1) of counter-current flow at the highest part of the impregnation vessel.

The requirement for steam pre-treatment can in this way be considerably reduced, while the amount of expelled weak gases is at the same time reduced to a minimum. A major part of the readily volatile compounds in the wood is bound in the withdrawn impregnation fluid (REC).

U.S. Pat. No. 5,679,217 reveals an impregnation method in which transfer fluid is withdrawn from the top separator of the digester. Furthermore, black liquor is withdrawn from the digester through a withdrawal strainer (8). The fluid withdrawn from the top separator and the black liquor are mixed in a line (11) and returned to the impregnation vessel. A portion of the mixture in the line (11) is led to the start of the impregnation vessel in order to there function as impregnation fluid. A second part of the mixture in the line (11) is heated and subsequently led to the bottom of the impregnation vessel in order to pre-heat the chips and to function as transfer fluid. The aim of this impregnation method is to optimise the fluid/wood ratio during the cooking process.

SE 527 058 reveals a method in which the chips after impregnation in an impregnation vessel are fed together with circulation fluid in a feed line to a top separator on a subsequent digester. A portion of the circulation fluid is withdrawn at the top separator and returned to the bottom of the impregnation vessel through a return line. Black liquor is withdrawn from the digester and passes to the impregnation vessel through a black liquor line. A heat exchanger is arranged between the return line and the black liquor line. The heat exchanger allows the transfer of heat between the two lines without allowing the exchange of fluids. The temperature of the black liquor has been reduced after its passage, while the temperature of the return line has at the same time been increased. Black liquor impregnation is achieved at a lower temperature with the invention, while the chips are at the same time heated at the bottom of the impregnation vessel, and this means that the need for heating by steam at the top of the digester is significantly reduced.

Characteristic of all of the technologies for impregnation described above is that the impregnation fluids that are used for the impregnation are directly adapted to be suitable for the digestion process that is used at the digestion plant, since the impregnation fluids that are used are fully, or partially, constituted by cooking fluid withdrawn from a subsequent digester.

A first object of the present invention is to achieve a method for the impregnation of chips in a continuous digestion system, where the impregnation method can be simply adapted for different cooking technologies such as, for example, LO-Solids, MCC and EMCC, where the impregnation can be carried out independently of the digestion process used.

A second object is to achieve an impregnation method in which the impregnation fluid is not constituted by a cooking fluid that has been withdrawn from a digester, but is constituted solely by the flows of the impregnation vessel itself, with the addition of white liquor.

A third object of the present invention is to obtain an impregnation that can be easily implemented in different cooking processes, by using the fluid flows that are already present in the digestion plant.

A fourth object is to avoid using black liquor withdrawn from the digester as impregnation fluid.

A fifth object is to use the heat energy from black liquor that is to be sent to the recovery process in order to heat the impregnation fluid.

SUMMARY OF THE INVENTION

The objects described above are achieved through no black liquor withdrawn from the digester being used as impregnation fluid in the impregnation vessel. Fluid withdrawn from a top separator is used as impregnation fluid, instead. The fluid withdrawn from a top separator is constituted by fluid that is present in the feed line between the outlet from the impregnation vessel and the top separator. Before the impregnation fluid (the fluid withdrawn from the top separator) is led to the impregnation vessel, the fluid is heated by passage through a heat exchanger, where hot black liquor allows a transfer of heat to the impregnation fluid. The hot black liquor is subsequently sent to the recovery process, after the heat content of the hot black liquor has been used to heat the fluid in the return line from the top separator.

Through the use solely of flows of fluids from the impregnation vessel itself, together with an addition of white liquor, which is used for the impregnation, it becomes very easy to apply the impregnation method in different digestion processes such as, for example, LO-Solids, MCC and EMCC.

DETAILED DESCRIPTION

The concept of "transfer flow" will be used in the following description. The term transfer flow is used here to denote the flow of fluids that is comprised by the impregnation vessel (101), the feed line (103), the top separator (105*a*/105*b*), the first return line (106*a*/106*b*), and the second return line (116).

Furthermore, the concept of "unimpregnated chips" will be used. This term is used to denote chips that have not been steam pre-treated or impregnated, such that the impregnation fluid has penetrated the fibre lumen. The chips may, on the other hand, have been sprayed with chemicals, which lie on the surface of the chips.

Figure 1:
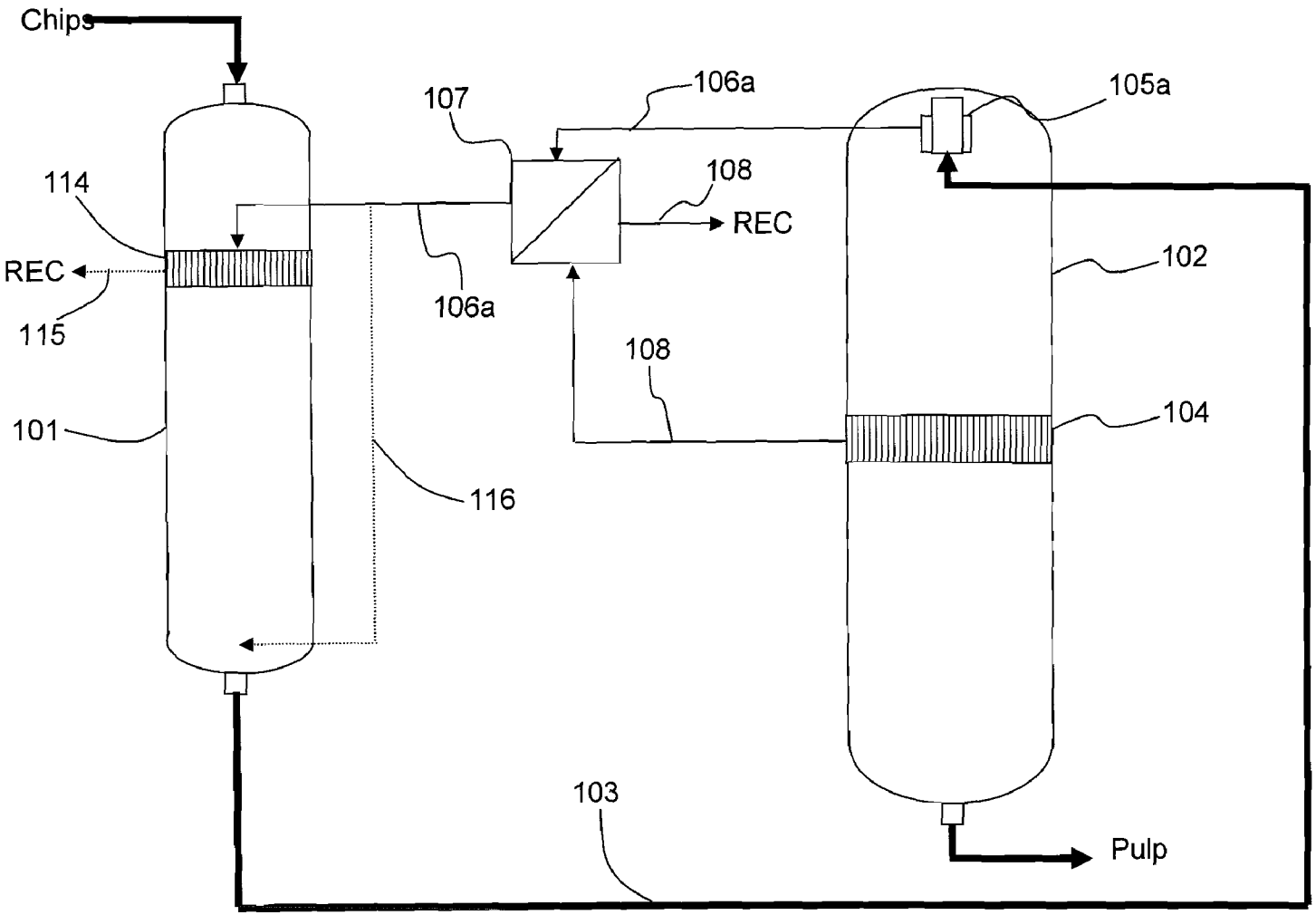
FIG. 1 shows a first and a second preferred embodiment according to the present invention.

FIG. 1 shows a first preferred embodiment of a method, according to the present invention, for the impregnation of chips in a continuous digestion system.

The digestion system comprises at least one impregnation vessel (101), to which unimpregnated chips are fed. The chips are pre-heated in the impregnation vessel (101) and formed into a sludge using impregnation fluid during a retention time of at least 10 minutes in the impregnation fluid. The pressure at the top of the impregnation vessel lies between atmospheric pressure and an excess pressure of 0.5 bar. The impregnation temperature in the impregnation vessel lies in the interval 100-140° C. When the impregnation is complete, the impregnated chips are fed out from the impregnation vessel through an outlet arranged in the bottom of the impregnation vessel.

The impregnated chips from the impregnation vessel (10) are subsequently fed in a feed line (103) to a top separator (105*a*) arranged at the top of a subsequent vessel (102). The amount of fluid that accompanies each tonne of wood lies in the interval 7-25 $m^3$, and this fluid accompanies the chips mixture in the feed line (103) up to the top separator (105*a*).

The chips mixture in the feed line (103) must be placed under pressure with a pressure-raising arrangement (not shown in the drawings), in order for it to reach the top of the top separator (105*a*/105*b*). This arrangement may consist of, for example, one or several pumps, high-pressure taps, or the equivalent.

The chips are cooked in the digester at a pre-determined cooking temperature, which lies in the interval 130-180° C., preferably within 140-160° C. The cooked chips (the pulp) are fed out from the digester after the cooking has been completed through an outlet in the bottom of the digester.

A portion of the fluid is withdrawn from the top separator (105*a*) in the feed line (103) and led to the impregnation vessel (101) in a first return line (106*a*), in order to function as impregnation fluid in the impregnation vessel (101). The amount of fluid that is led from the top separator (105*a*) in the first return line (106*a*) after dewatering is 5-23 $m^3$ per tonne of wood. Less than 3.5 $m^3$ of fluid per tonne of wood accompanies the chips into the digester after the chips mixture has been dewatered in the top separator (105*a*).

More than 75% of the total amount of fluid that is added to the impregnation vessel is constituted by fluid withdrawn in the first return line (106*a*).

A withdrawal of hot black liquor to a black liquor line (108) is made from a withdrawal strainer (104) at the digester (102). The black liquor that is withdrawn to the black liquor line (108) maintains essentially the cooking temperature, and essentially full cooking pressure, and it has an alkali content that lies below 10 g/l. The black liquor in the black liquor line (108) is subsequently led to the recovery process (REC).

A first heat exchanger (107) is arranged between the first return line (106*a*) and the black liquor line (108). The first heat exchanger (107) allows a transfer of heat between the two lines, such that the fluid in the first return line (106*a*) is heated. No exchange of fluids between the fluids in the two lines occurs in the first heat exchanger (107).

More than 50% of the total amount of white liquor that is added to the digestion process is added to the transfer flow. The amount of white liquor that is added in the transfer flow amounts to at least 1 $m^3$ per tonne of wood. It is preferable that this addition of white liquor is added in the first return line (106*a*/106*b*), or at least 30% of the total addition of white liquor is added in the first return line.

Other fluids can be added to the transfer flow, in addition to the addition of white liquor. These may be, for example, black liquor or washing liquor, they are limited in their extent, and they function solely as additional fluids in order to establish a sufficiently high fluid/wood ratio in the transfer flow. These fluids, known as "make-up fluids" or "additional fluids", are not intended to function as impregnation fluids. Less than 0.5 $m^3$ fluid per tonne of wood that is added in the transfer flow is constituted by other fluids than the addition of white liquor.

The principal part of the fluid contents of the impregnation vessel (101) is constituted by chips moisture, steam condensate, added white liquor, and the fluid withdrawn from the top separator at the first return line (106*a*), whereby the impregnation fluid in the impregnation vessel does not contain any substantial amount of black liquor from the digester. In this way, an impregnation vessel is established that is hydraulically isolated, in which the flow of fluid and the establishment of its alkali content take place without any influence from the fluid flow in the digester process.

A portion of fluid may be withdrawn from the impregnation vessel (101) through a strainer (114) and sent to the recovery process (REC) through a recovery line (115).

Also a second preferred embodiment is shown in FIG. 1, which embodiment is an addition to the first embodiment. A partial amount of the fluid in the first return line (106) is led, after its passage through the first heat exchanger (107), to a second return line (116), in which the fluid is led to the bottom of the impregnation vessel (101), in order there to pre-heat and dilute the chips, before they are led out from the impregnation vessel.

This second embodiment is otherwise identical with the first preferred embodiment.

Figure 2:
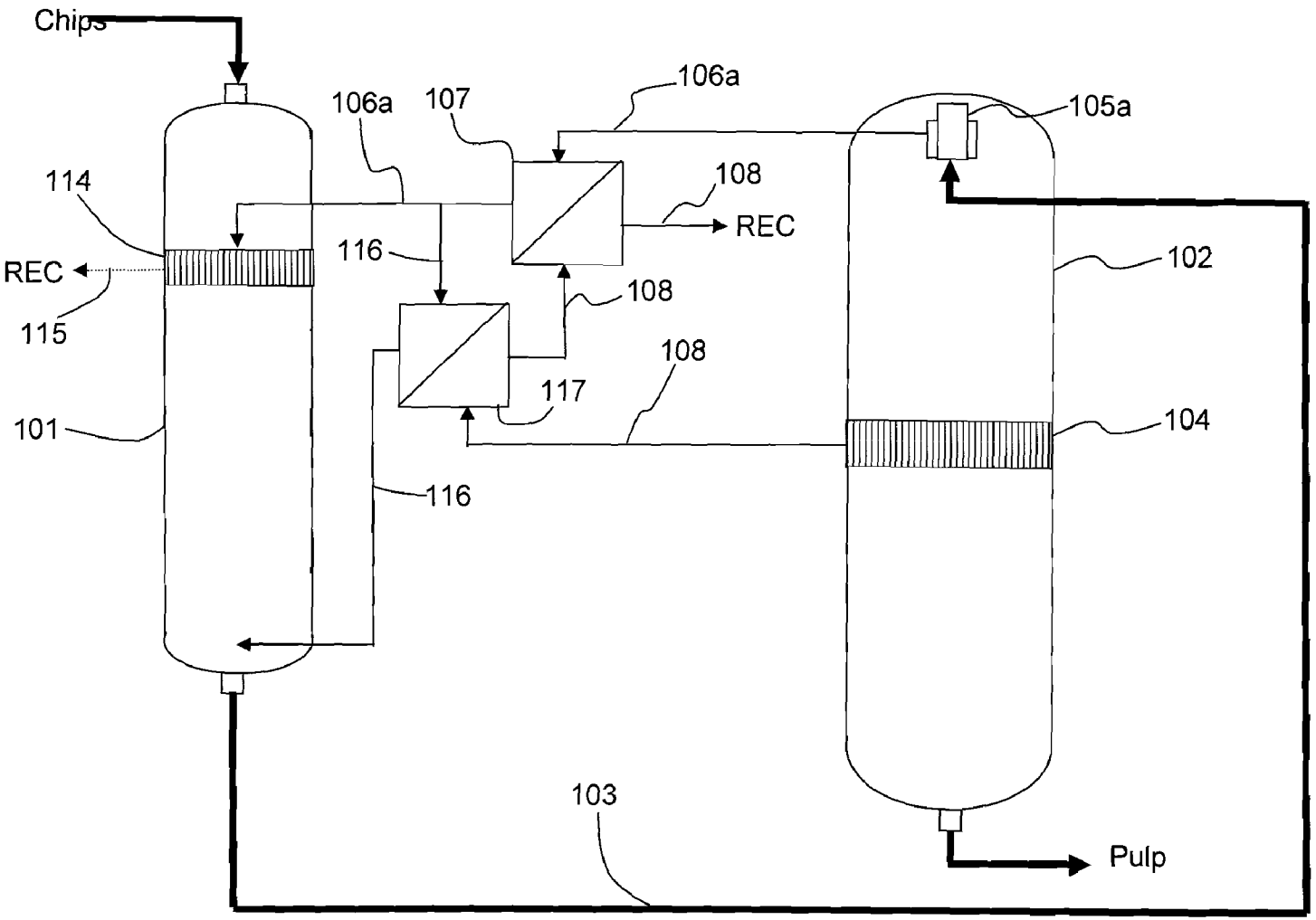
FIG. 2 shows a third alternative embodiment according to the present invention, where a portion of the fluid withdrawn from the top separator is led to the bottom of the impregnation vessel.

FIG. 2 shows a third preferred embodiment, in which a second heat exchanger (117) is included in order to heat the fluids that have been withdrawn from the top separator (105*a*) and are led to the impregnation vessel (101).

The withdrawn black liquor is in this case led in a black liquor line (108) to a second heat exchanger (117) and subsequently to the first heat exchanger (107), before the black liquor is sent to the recovery process (REC).

In a manner equivalent to that of previously shown embodiments, the fluid that has been withdrawn is led in the first return line (106*a*) to the upper section of the impregnation vessel, after passing the first heat exchanger (107*a*), where the fluid is heated after heat transfer from the black liquor in the black liquor line (108).

A partial amount of the transfer fluid is led in the first return line (106), after its passage through the first heat exchanger (107), to a second return line (116), in which the fluid passes the second heat exchanger (117), and it is heated by heat transfer from the black liquor in the black liquor line (108). After being heated in the second heat exchanger (117), the partial portion of circulation fluid is led in the second return line (116) onwards to the bottom of the impregnation vessel (101), in order there to pre-heat the chips, before the chips are fed out to the feed line (103).

The third embodiment is otherwise identical with the first embodiment shown above.

Figure 3:
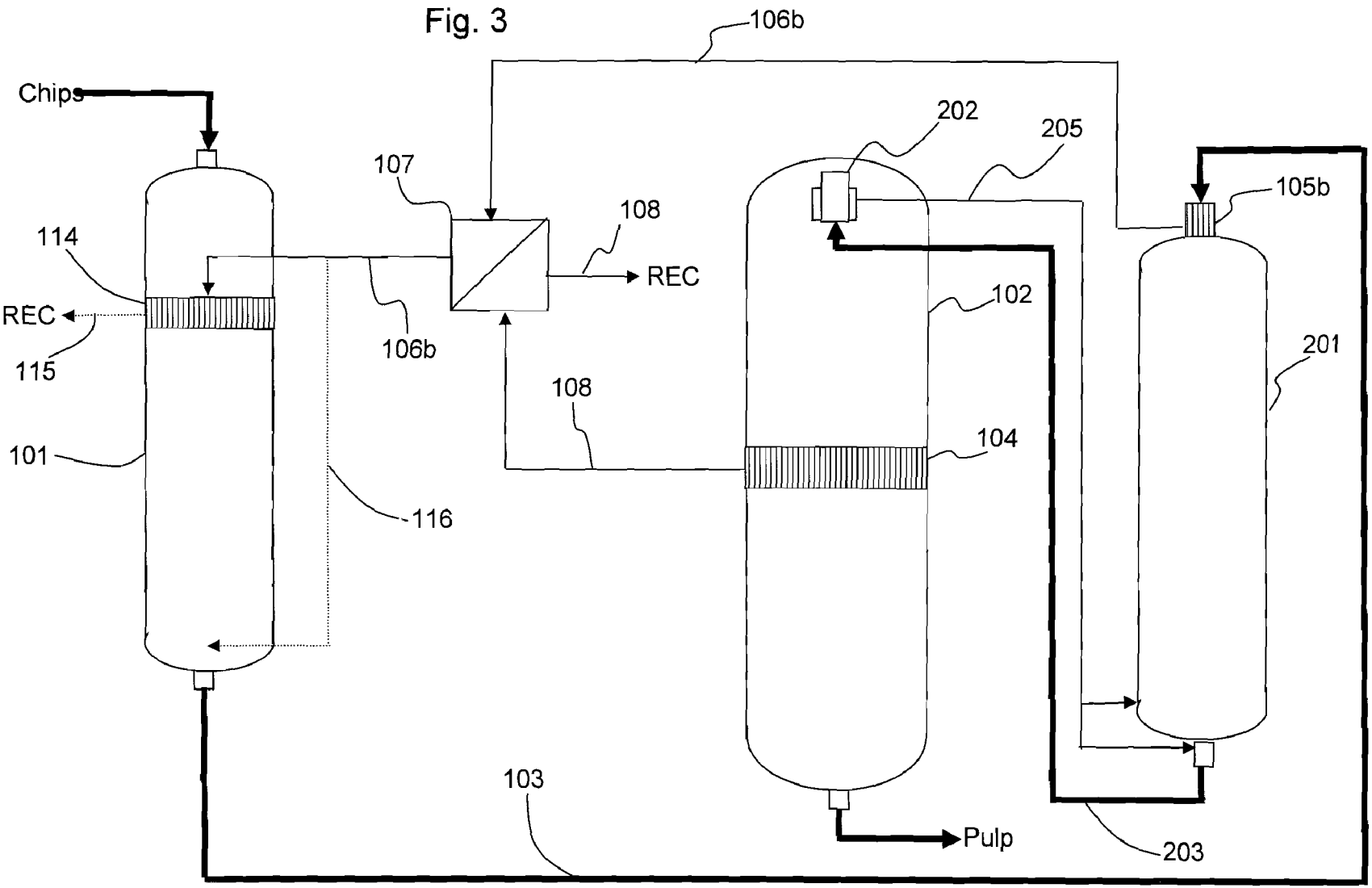
FIG. 3 shows a fourth and a fifth alternative embodiment according to the present invention, where the digestion system comprises a second impregnation vessel.

A fourth and a fifth preferred embodiment are shown in FIG. 3, where the embodiments in FIG. 1 have been adapted to include a second impregnation vessel (201). The impregnated chips are fed out from the impregnation vessel (101) in the fourth embodiment and pass in a feed line (103) to a top separator (105*b*), arranged at the top of a pressurised second impregnation vessel (201), where the chips are further impregnated. The pressure level of the second impregnation vessel is an excess pressure of at least 5 bar at the top of the vessel (201). The chips are fed, after the impregnation in the impregnation vessel has been completed, in a chips line (203) to a top separator (202), arranged at the top of a subsequent digester (102).

Fluid is withdrawn from the top separator of the digester (202), and it is led to the bottom of the second impregnation vessel (201) in order there to facilitate the output of chips to the chips line (203).

A portion of the fluid is withdrawn from the top separator (105*b*) in the feed line (103) and led to the impregnation vessel (101) in a first return line (106*b*), in order to function as impregnation fluid in the impregnation vessel (101).

A first heat exchanger (107) is arranged between the first return line (106*b*) and the black liquor line (108). The first heat exchanger (107) allows a transfer of heat between the two lines, such that the fluid in the first return line (106*b*) is heated. No exchange of fluids between the fluids in the two lines occurs in the first heat exchanger (107).

The fourth embodiment described in FIG. 3 agrees otherwise with the first embodiment previously described in FIG. 1.

A fifth preferred embodiment is also shown in FIG. 3, which embodiment is an addition to the fourth embodiment. A portion of the fluid is led, after its passage through the first heat exchanger (107), in the first return line (106) to a second return line (116), in which the fluid is led to the bottom of the impregnation vessel (101), in order there to pre-heat and dilute the chips, before they are led out from the impregnation vessel.

Figure 4:
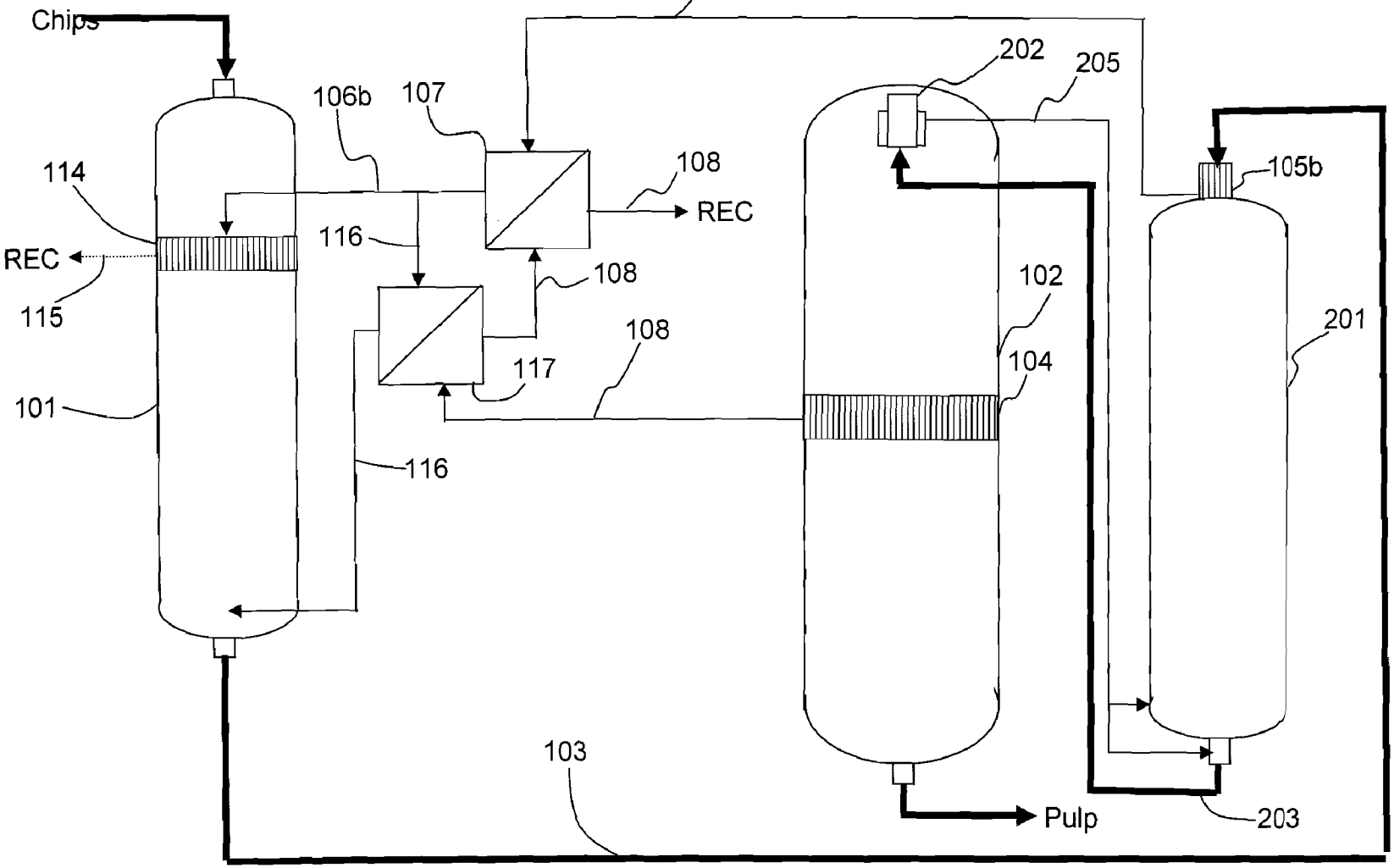
FIG. 4 shows a sixth alternative embodiment according to the present invention, where the digestion system comprises a second impregnation vessel.

A sixth preferred embodiment of the invention is shown in FIG. 4, where the third preferred embodiment in FIG. 2 has been adapted to include a second impregnation vessel (201). The impregnated chips are fed out from the impregnation vessel (101) and pass in a feed line (103) to a top separator (105*b*), arranged at the top of a pressurised second impregnation vessel (201), where the chips are further impregnated. The pressure level of the second impregnation vessel is an excess pressure of at least 5 bar at the top of the vessel (201). The chips are fed, after the impregnation in the impregnation vessel has been completed, in a chips line (203) to a top separator (202), arranged at the top of subsequent digesters (102).

Fluid is withdrawn from the top separator of the digester (202), and it is led to the bottom of the second impregnation vessel (201) in order there to facilitate the output of chips to the chips line (203).

A portion of the fluid is withdrawn from the top separator (105*b*) in the feed line (103) and led to the impregnation vessel (101) in a first return line (106*b*), in order to function as impregnation fluid in the impregnation vessel (101).

A first heat exchanger (107) is arranged between the first return line (106*b*) and the black liquor line (108). The first heat exchanger (107) allows a transfer of heat between the two lines, such that the fluid in the first return line (106*b*) is heated. No exchange of fluids between the fluids in the two lines occurs in the first heat exchanger (107).

The sixth embodiment described in FIG. 4 agrees otherwise with the third embodiment previously described in FIG. 2.

The impregnation method according to the invention achieves the following advantages, and other advantages, with respect to the prior art:

- The impregnation procedure can be simply adapted for different cooking technologies such as, for example, LO-Solids, MCC and EMCC, since the impregnation can be carried out independently of the digestion process used.
- The principal part of the fluid contents of the impregnation vessel (101) is constituted by chips moisture, steam condensate, added white liquor, and the fluid withdrawn from the top separator at the first return line (106*a*/106*b*), whereby the impregnation fluid in the impregnation vessel does not contain any substantial amount of black liquor from the digester. In this way, an impregnation vessel is established that is hydraulically isolated, in which the flow of fluid and the establishment of its alkali content take place without any influence from the fluid flow in the digester process.

The invention is not limited to that which has been described above: several variants are possible within the scope of the attached patent claims. It is possible, for example, to arrange more than one heat exchanger in the return line (106*a*/106*b*) between the top separator (105*a*/105*b*) and the impregnation vessel (101).

While the present invention has been described in accordance with preferred compositions and embodiments, it is to be understood that certain substitutions and alterations may be made thereto without departing from the spirit and scope of the following claims.

The invention claimed is:

1. A method for impregnating chips in a continuous digestion system, comprising:

feeding un-impregnated chips to the impregnation vessel;

pre-heating, impregnating and forming the chips into a chips mixture using impregnation fluid;

feeding impregnated chips mixture in a feed line from the impregnation vessel to a top separator arranged in a digester, withdrawing a hot black liquor from a withdrawal strainer in the digester and sending the withdrawn hot black liquor in a black liquor line;

withdrawing fluid from the top separator and leading the withdrawn fluid in a first return line to the impregnation vessel;

transferring heat from the black liquor line to the first return line in a heat exchanger arranged between the first return line and the black liquor line;

more than 75% of the fluid added to the impregnation vessel being constituted by fluid withdrawn in the first return line;

a principal part of a fluid contents in the impregnation vessel being constituted by chips moisture, steam condensate, added white liquor, and the fluid withdrawn from the top separator into the first return line;

the impregnation fluid in the impregnation vessel not containing any black liquor from the digester;

and flowing fluid and establishing an alkali content in the impregnation vessel without any influence from a fluid flow in a digester process in the digester.

2. The method according to claim 1, wherein a portion of fluid is withdrawn from the impregnation vessel, through a strainer in the impregnation vessel, and sent to the recovery process.

3. The method according to claim 1, wherein a portion of the fluid in the first return line is sent, after passing through the heat exchanger, in a second return line to a bottom of the impregnation vessel.

4. The method according to claim 3, wherein a portion of fluid in the second return line is further heated by passage through a second heat exchanger before the portion of fluid withdrawn from the first return line is sent to the bottom of the impregnation vessel.

5. The method according to claim 4, wherein black liquor is led to the second heat exchanger through the black liquor line, and where the second heat exchanger transfers heat from the black liquor in the black liquor line to the fluid in the second return line.

6. The method according to claim 1, wherein the top separator is arranged at the top of the digester.

7. The method according to claim 1 wherein the method further comprises arranging a second top separator at a top of a second impregnation vessel, where the chips are further impregnated, and where the impregnated chips are subsequently fed in a chips line to a top separator arranged at a top of the digester.

8. The method according to claim 7, wherein the method further comprises withdrawing fluid from the top separator at the digester (102), and leading this withdrawn fluid in a fluid line to a bottom of the second impregnation vessel.

9. The method according to claim 7, wherein the method further comprises placing the second impregnation vessel under an excess pressure of at least 5 bar.

10. The method according to claim 1, wherein the method further comprises adding more than 30% of a total addition of white liquor to the first return line.

11. A method for impregnating chips in a continuous digestion system, comprising:

feeding un-impregnated chips to an impregnation vessel;

impregnating the chips in the impregnation vessel;

feeding impregnated chips in a feed line from the impregnation vessel to a top separator arranged in a digester;

withdrawing a hot black liquor from a withdrawal strainer in the digester and sending the withdrawn hot black liquor in a black liquor line a recovery process;

withdrawing fluid from the top separator and leading the withdrawn fluid in a first return line to the impregnation vessel;

transferring heat from the black liquor line to the first return line in a heat exchanger arranged between the first return line and the black liquor line; and using the withdrawn fluid from the top separator for impregnating the chips in the impregnation vessel without using any black liquor, withdrawn from the digester, for impregnation of the chips disposed in the impregnation vessel.

12. The method according to claim 11, wherein the method further comprises establishing an alkali content in the impregnation vessel by using the fluid withdrawn from the top separator.

13. The method according to claim 11, wherein the method further comprises heating the withdrawn fluid from the top separator prior to using the withdrawn fluid to impregnate the chips.

* * * * *